United States Patent [19]

Lukianoff

[11] Patent Number: 4,501,096

[45] Date of Patent: Feb. 26, 1985

[54] HAND-HELD SANDING DEVICE

[76] Inventor: Sergei G. Lukianoff, 1049 Folger Ave., Berkeley, Calif. 94701

[21] Appl. No.: 454,608

[22] Filed: Dec. 30, 1982

[51] Int. Cl.[3] ..... B24D 15/00

[52] U.S. Cl. ..... 51/391; 51/370

[58] Field of Search ..... 51/358, 363, 370, 371, 51/381, 391

[56] References Cited

U.S. PATENT DOCUMENTS

| | | | |
|---|---|---|---|
| 1,562,414 | 11/1925 | McKnight | 51/371 |
| 1,844,996 | 2/1932 | Walker | 51/391 X |
| 2,103,320 | 12/1937 | Corff | 51/371 |
| 2,112,593 | 3/1938 | Campbell | 51/370 |
| 2,396,418 | 3/1946 | Grenzow | 51/370 |
| 2,493,852 | 1/1950 | Bonkowski | 51/391 X |
| 3,777,444 | 12/1973 | Dunn | 51/391 |
| 3,998,012 | 12/1976 | Ness | 51/391 |

FOREIGN PATENT DOCUMENTS

| | | | |
|---|---|---|---|
| 167395 | 8/1921 | United Kingdom | 51/371 |

*Primary Examiner*—Robert P. Olszewski

*Attorney, Agent, or Firm*—Bruce & McCoy

[57] ABSTRACT

A hand-held sanding device holds a sheet of sandpaper or other abrasive sheet material around the three intersecting faces of a resilient, generally triangularly shaped block. While two of the block faces are flat right-angled surfaces the third face is a generally curved surface extending between the two flat surfaces. An angled receiving slot laterally extends along and bisects the block's curved surface, and serves to hold the ends of the sandpaper wrapped around the block in such a manner that sanding pressure placed on any surface of the block will cause the receiving slot to tighten its grip on the sandpaper ends. The block is fabricated of deformable polystyrene, has corners with three different angles and sanding surfaces of different sizes, including a curved sanding surface, and is easily gripped to handle a variety of different sanding jobs.

12 Claims, 6 Drawing Figures

FIG.—1
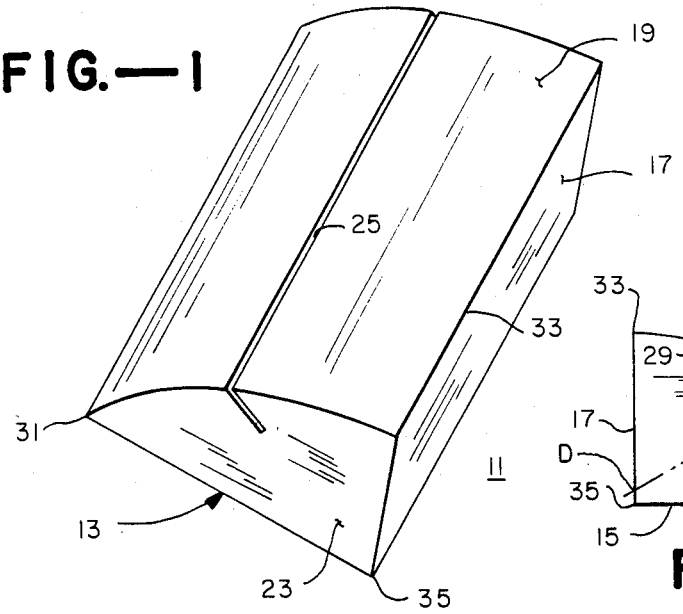
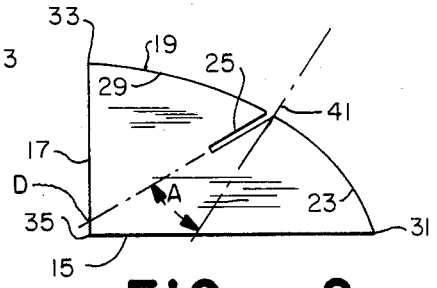
FIG.—2
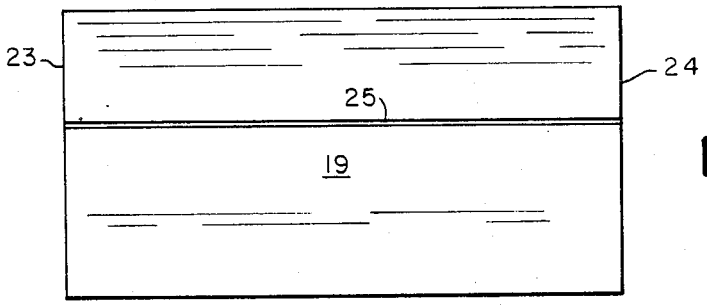
FIG.—3
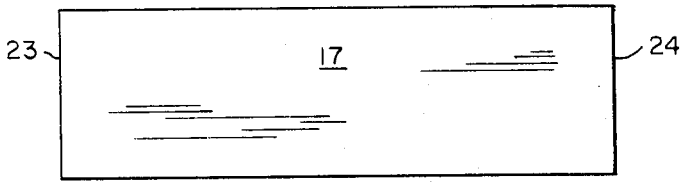
FIG.—4
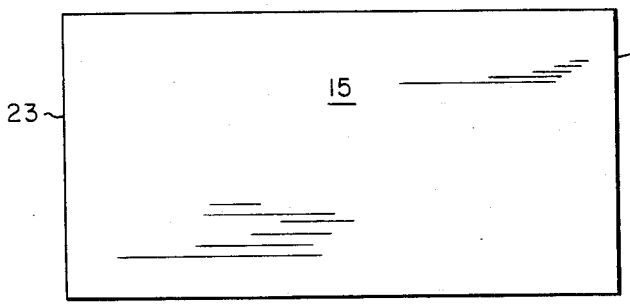
FIG.—5
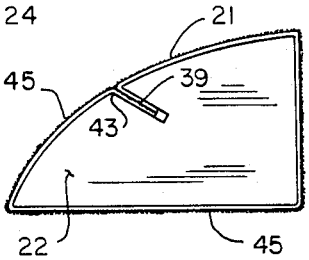
FIG.—6

HAND-HELD SANDING DEVICE

BACKGROUND OF THE INVENTION

The present invention generally relates to the field of hand tools, and more particularly relates to hand-sanding devices used to hold the sandpaper to provide a working grip for sanding.

Small sanding jobs and sanding jobs calling for considerable detail work or access to small confined areas will usually call for the direct hand application of sandpaper of one or more suitable grit sizes. The difficulty in hand-sanding is in applying firm pressure long enough to complete the job and in applying even pressure to obtain a desired smooth and even finish. A further difficulty is to obtain efficient use of the sandpaper by not wasting any substantial portion of its surface area.

To facilitate hand sanding square sanding blocks, sized to fit the hand, have been used for years. By using a sanding block as a sandpaper holder, hand-applied sanding forces can be increased and more evenly distributed. However, one of the problems encountered in typically make-shift square sanding blocks is the tendency of the sandpaper to rip off the block when in use. Another problem is that the block dimensions limit the ability of the sander to sand curved surfaces and get into hard to access corners and other locations, such as frequently found around window sills and door jams. Block sandpaper holders are also generally made of scrap wood material with a hard non-resilient surface, frequently causing the sander to overly cut or gouge the sanded surface.

The present invention is a hand-held sanding device for use with sandpaper or other abrasive sheet material which overcomes the above limitations of conventional block sandpaper holders by providing a device around which a sheet of sandpaper can be wrapped and easily secured. The invention actively holds the sandpaper around the device during any sanding operation without mechanical attachments such as staples, tacks, nails, or the like. The hand-held sanding device of the invention renders usable practically the entire sandpaper surface and, in addition, provides three different surface configurations, including a curved surface, uniquely adapted to handle most hand sanding operations and surface configurations. The device of the invention provides three separate corner angles, preferably a 90 degree angle, a 60 degree angle, and a 45 degree angle, for handling a variety of corner and crevice configurations. The device of the invention can be used with wet or dry sandpaper, provides a resilient backing surface which will sand, but not break off or gouge raised surface areas.

SUMMARY OF THE INVENTION

In the present invention a hand-held sanding device for use with sandpaper or other abrasive sheet material is generally comprised of a resilient block having three laterally extending intersecting faces which form a block perimeter surface about which sandpaper material can be wrapped. At the two lateral ends of the block there are two additional cross-cut surfaces. The three intersecting block faces supporting the sandpaper consist of one substantially flat bottom surface, one substantially flat side surface perpendicular to the bottom surface, and one top, curved surface extending in a single convex curve from the bottom surface upwardly to the top surface. It will be seen that these three intersecting surfaces provide a generally triangular and uniform cross-sectional shape to the block and that the intersection of these surfaces provide three laterally extending block corners of different angles.

In accordance with the invention the block's top curved surface has a receiving slot intermediate and substantially parallel to the laterally extending corners of the block which bound this curved surface, with the receiving slot having a width to snuggly receive the two ends of a sandpaper material when the sandpaper is tightly wrapped around the block perimeter surface: thusly, is the sandpaper held on the block. It is contemplated that, by using a resilient deformable block material, the pressures on the block surfaces created by sanding will cause the receiving slot to deform to tightly grip the inserted sandpaper ends.

Therefore, it is seen that the primary object of the present invention is to provide a hand-held sanding device which self-grips the sandpaper and provides suitable holding pressure against the sandpaper ends to prevent the sandpaper from tearing off the device during any sanding operation.

It is a further object of the present invention to provide a hand-held sanding device having three differently dimensioned sanding surfaces, including one curved surface, for handling different sanding operations.

It is another object of the invention to provide a hand-held sanding device which provides three different angled corners for sanding a variety of different corner and crevice areas. In the preferred embodiment of the invention it is generally contemplated that the sanding device will be able to be inserted up to one inch in hidden surface areas, such as around molding and in window frame guides.

It is still a further object of the invention to provide a device capable of holding most types of sandpaper, including wet and dry sandpaper, or emery cloth.

It is still another object of the invention to provide a sanding device which has the overall resiliency to ride over surface irregularities without damaging the surface.

It is yet another object of the invention to provide a hand-held sanding device wherein the sandpaper can be held on the device without the aid of mechanical attachments.

It is yet a further object of the invention to provide a hand-held sanding device wherein practically the entire paper surface area is usable.

Yet further objects of the invention will become apparent from the following specification and claims.

DESCRIPTION OF THE DRAWINGS

FIG. 1 of the drawings is an isometric view of a hand-held sanding device in accordance with the invention;

FIG. 2 is an end elevation view thereof;

FIG. 3 is a top planned view thereof;

FIG. 4 is a side elevation view thereof taken from the right side of FIG. 1;

FIG. 5 is a bottom planned view thereof; and

FIG. 6 is an end elevation view of the hand-held sanding device illustrated in the previous figures showing a sheet of sandpaper secured thereto.

DETAILED DESCRIPTION OF THE PREFERRED EMBODIMENT

Referring now to the drawings, the block sander of the invention is generally denoted in FIG. 1 by the numeral 11. A block 13 having a uniform, generally triangular cross-sectional shape is fabricated of a resilient, deformable material which will tend to deform against rough and raised surface areas, thereby sanding these areas without damaging the surface; as will be discussed below, the deformable material will also enhance the block's ability to hold the sandpaper to the block. The material used in fabrication of the block is preferably polystyrene which has the characteristic of being light and resilient as well as relatively strong. It has been discovered that from three pound to four and half pound polystyrene is the most suitable grade of polystyrene for fulfilling the objects of the invention, however, it is understood that the invention is not limited to this range and that grades of polystyrene outside this range might be used.

It is seen that block 13 has three intersecting faces 15, 17, 19 which form a block perimeter surface about which a sheet of sandpaper or other abrasive sheet material can be wrapped, such as the sandpaper 21 shown wrapped around the block 22 shown in FIG. 6; the other two faces of the block are the two end surfaces 23, 24 which define the length of the block and which are preferably perpendicular cross cuts. It is seen that, with its uniform cross-sectional shape, the block can be fabricated in long lengths which, in the fabricating process, can be cut into a number of smaller usable lengths.

With reference to FIG. 2, the three block faces 15, 17, 19, which form 360 degrees of perimeter surface, is comprised of one substantially flat bottom surface 15 and one substantially flat side surface 17 perpendicular to the bottom surface, with the side surface having a smaller width than the bottom surface. The other face is the top surface 19 which extends in a single convex curve about the lengthwise axis of the block from the bottom surface 15 upwardly to the side surface 17. The top surface 19 is bisected by the receiving slot 25 which laterally extends the full length of the block. The curvature of the lower portion 27 of the curved surface 19 (that portion generally below the receiving slot 25) is generally steeper, that is it has a smaller radius of curvature, than the curved surface's top portion 29 which is more gradual. This provides a sanding surface with a continuously varying curvature as well as block corners 31, 33 having different angles.

It has been discovered that certain dimensions for the above-described block surfaces are uniquely adapted to handle a variety of sanding chores as described in the foregoing discussion of the background of the invention. In the preferred embodiment the block will have the following approximate dimensions: the width of the bottom surface 15 will be approximately $2\frac{3}{4}$ inches while the height of the side surface 17 will be approximately $1\frac{3}{4}$ inches; and the curved top surface will measure approximately $3\frac{1}{4}$ inches along its curve from the side surface to the bottom surface. The radius of the top portion 29 of the curve above the receiving slot 25 will be approximately $5\frac{1}{4}$ inches and the radius of the steeper, lower portion 27 of the curve will be approximately two inches. The length of the block is less critical, however, it is found that a convenient length which easily fits into the hand is approximately $5\frac{1}{2}$ inches. It is understood that the invention is not limited to the above dimensions and that within the spirit of the invention the dimensions can be scaled up or down, or varied somewhat while still achieving the objects of the invention.

From the foregoing and from FIG. 2 of the drawings, it is seen that the three corners 31, 33, 35 of the block will, and should have, angles of approximately 45 degrees, 60 degrees, and 90 degrees, respectively. By providing three different angles, a variety of different sanding requirements can be accommodated.

The position and orientation of the block's receiving slot 25 will contribute to the gripping power of the receiving slot in holding the edges 39 of the sandpaper 21. Preferably, the receiving slot is angled back toward the side surface 17 in reference to a normal plane perpendicular to top surface 19. The reference plane is represented by the center line 41 in FIG. 2, and the plane of the slot is represented by the numeral 42. It is found that the slot, for the best gripping action and to reduce the possibility of splitting, should be positioned on the curve surface such that the slot plane 42 intersects the side wall 17 approximately $\frac{1}{4}$ inch to $\frac{1}{2}$ inch from the bottom surface 15. This distance is represented by the letter "D" in FIG. 2 and is based on the overall preferred dimensions for the block as discussed below, which dimensions are scalable. The degree of angulation, A, between the receiving slot and the normal plane 41 will be approximately 30 degrees for a centrally located slot. It is found that with the deformable material of the block in which the receiving slot is cut, the receiving slot will be compressed closed to tightly grip the sandpaper no matter where pressure is applied to the block's perimeter surfaces 15, 17, 19. For example, if the lower portion 27 of the top curved surface 19 is used for sanding, the normal force against the block at this point together with the co-acting force of the hand gripping the block's bottom surface 15 and side surface 17 will force the receiving slot closed. Likewise, the receiving slot will be forced closed while sanding with the bottom or side surfaces 15, 17 while gripping the top curved surface 19. In all sanding positions, the top of the receiving slot 43 tends to pinch the folded over tips of the sandpaper 39. It is noted that if the slot were cut perpendicular to the curved surface 19 along the normal plane 41, sanding along the top curved surface in the vincinity of the slot may tend to spread the slot and loosen its grip on the sandpaper; conversely if the slot is angled substantially toward the curved surface, the fold over of the lower edge 45 of the sandpaper will be very slight and this edge may tend to slide out relatively easily where no pressure or relatively slight pressure is placed on the block.

As to the dimensions of the receiving slot, it has been found that a slot depth of approximately three quarters of an inch is suitable, and that the slot should have a width of approximately 1/16 of an inch. On the top curved surface, the slot is placed intermediate to the two corners 30 and 33 approximately two inches down on the curved surface from the top corner 33. It is found, and is believed that in terms of achieving the objects of the invention of securely and releasably holding the sandpaper, that the most critical of the slot dimensions is the slot width. The placement of the slot on the curved surface may vary somewhat, however, it is desirable to have it close to the center point on the curved surface, and to perferably have it in the position above-described.

Therefore, it is seen that the present invention is a hand-held sanding device capable of securely and releasably holding a piece of sandpaper or other abrasive sheet material around its perimeter by means of a suitable constructed receiving slot 25 located along the curved surface of the block's three sanding surfaces, 15, 17, 19. The receiving slot is located and positioned so that sanding forces will actually increase the gripping power of the slot and prevent the ends of the sandpaper from slipping out. It is also seen that the invention provides a hand-held sanding device with a variety of different sanding surfaces and corners to handle a variety of different sanding chores in a single hand-held, light weight, and durable device.

While the present invention has been described in considerable detail in the foregoing specification, it is not intended that such detail limit the scope of the invention. It is rather intended that the scope of the invention be defined by the claims which are as follows.

I claim:

1. A hand-held sanding device for use with sandpaper or other abrasive sheet material, comprising a resilient block having three laterally extending intersecting block faces forming block perimeter surfaces about which said abrasive sheet material can be wrapped, and two end surfaces defining the length of said block, said three intersecting block faces consisting of one substantially flat bottom surface, one substantially flat side surface substantially perpendicular to said bottom surface, and one top surface extending in a single convex curvature from said bottom surface upwardly to said side surface, the intersection of said top, bottom and side surfaces forming three laterally extending block corners, said curved top surface having a receiving slot formed therein intermediate and substantially parallel to the laterally extending edges of said curved top surface, said receiving slot being of a width to snuggly receive the two ends of abrasive sheet material when tightly wrapped around the block perimeter surface to hold same in its tightly wrapped position.

2. The sanding device of claim 1 wherein the bottom surface of said block is wider than said block side surface and wherein the bottom portion of the top curved surface below said receiving slot has a smaller radius of curvature than the top portion of said curve above said receiving slot.

3. The sanding device of claim 1 wherein said receiving slot is angled back toward said side surface in reference to a normal plane passing through said top surface at the top surface opening of the slot.

4. The sanding device of claim 3 wherein said receiving slot is located slightly below the center of said curved surface and wherein the angle of said receiving slot in reference to said normal plane is approximately 30°.

5. The sanding device of claim 2 wherein the intersection of said top curved surface and said bottom that surface occurs at an approximately 45° angle and the intersection of said top curved surface and said that side surface occurs at an approximately 60° degree angle.

6. The sanding device of claim 1 wherein said block is fabricated of polystryrene.

7. The sanding device of claim 6 wherein said block is fabricated of from 3 to $4\frac{1}{2}$ pound polystyrene.

8. A hand-held sanding device for use with sandpaper or other abrasive sheet material, comprising a resilient block having three laterally extending intersecting faces forming block perimeter surfaces about which said sheet material can be wrapped, and two end surfaces defining the length of said block, said intersecting block faces consisting of one substantially flat bottom surface, one substantially flat side surface substantially perpendicular to said bottom surface, and one top surface extending in a single convex curvature from said bottom surface upwardly to said side surface, and the bottom portion of the top curved surface having a smaller radius of curvature than the top portion of said curved surface, the intersection of said top, bottom, and side surfaces forming three laterally extending block corners of approximately 45, 60, and 90 degrees, said curved top bottom surface having a receiving slot formed therein intermediate and substantially parallel to the lateral extending edges of said curved top surface, said receiving slot being angled towards said side surface in reference to a normal plane passing through said top surface at the top opening of said slot and said receiving slot being of a width to snuggly receive the two ends of abrasive sheet material when tightly wrapped around the block perimeter surface to hold same in a tightly wrapped position.

9. The sanding device of claim 8 wherein the width of the bottom surface of said block is approximately $2\frac{3}{4}$ inches, the height of the side surface of said block is approximately $1\frac{3}{4}$ inches, and the curved top surface of said block measures approximately $3\frac{1}{4}$ inches along its curve from the side surface to the bottom surface.

10. The sanding device of claim 9 wherein said block is fabricated of from 3 to $4\frac{1}{2}$ pound polystyrene.

11. The sanding device of claim 10 wherein the width of said slot is approximately $\frac{1}{8}$ of an inch.

12. The sanding device of claim 9 wherein the plane of said slot intersects the side wall of said block approximately $\frac{1}{4}$ inch to $\frac{1}{2}$ inch above said bottom wall.

* * * * *